United States Patent [19]

Benimetzki

[11] 4,052,078

[45] Oct. 4, 1977

[54] POWER TRANSMISSION COLLAR

[76] Inventor: Eliezer Benimetzki, c/o Brilliant Lighting Fixture Corp., 12 W. 31st St., New York, N.Y. 10001

[21] Appl. No.: 593,745

[22] Filed: July 7, 1975

Related U.S. Application Data

[62] Division of Ser. No. 481,872, June 21, 1974, Pat. No. 3,906,775.

[30] Foreign Application Priority Data

July 1, 1973 Israel ..... 42637

[51] Int. Cl.[2] ..... B23B 47/00; F16D 11/06

[52] U.S. Cl. ..... 279/93; 173/29; 192/41 R

[58] Field of Search ..... 279/93, 7, 1 B, 1 T, 279/76, 78; 30/500; 192/41 R, 46; 403/105; 173/29, 163

[56] References Cited

U.S. PATENT DOCUMENTS

| | | | |
|---|---|---|---|
| 305,140 | 9/1884 | Bradley | 279/93 X |
| 1,522,980 | 1/1925 | Roco et al. | 192/41 R |
| 2,964,115 | 12/1960 | Clatfelder | 173/163 X |

*Primary Examiner*—Othell M. Simpson
*Assistant Examiner*—Z. R. Bilinsky
*Attorney, Agent, or Firm*—John R. Ewbank

[57] ABSTRACT

A hand tool having a motor rotating a drilling bit is made more useful by a power transmission collar. An auxiliary tool, such as a riveter, scheduled for use selectively during intervals between drilling operations, is powered by the electric drill. The auxiliary tool has a driven member with a well adapted to receive the bit. A power transmission collar is secured to the bit near the chuck of the drill. The collar has self-guiding spiral surfaces and pin-engageable surfaces. The driven member has a socket featuring a single pin toward which the spiral surfaces guide the collar to the pin-receptive surface for the power transmission connection.

1 Claim, 10 Drawing Figures

POWER TRANSMISSION COLLAR

This is a division of application Ser. No. 481,872, filed June 21, 1974, now U.S. Pat. No. 3,906,775.

FIELD OF INVENTION

This invention relates to tools adapted to set the type of blind tubular rivet which has a mandril which can be pulled to anchor the remote portion of the blind rivet. The invention also concerns the combination of a power transmission collar and power transmission socket powering a supplemental tool used intermittently with a hand-held electric drill for minimizing loss of time in shifting to and from drilling holes and use of such supplemental tool.

PRIOR ART

In the installation of duct work and other custom built construction, there are situations in which there is need for fastening components by the installation of a rivet from one side. For several years there have been blind rivets having a setting means comprising a mandril and an enlarged head. The nose of a riveting tool is held against the radially enlarged flange of the rivet as the mandril of the blind rivet is pulled, thereby causing the remote portion of the tubular blind rivet to be expanded, set, and anchored as the head is pulled rearwardly. The blind rivet is equipped with a narrow neck portion so that immediately after the mandril has been pulled sufficiently to achieve the desired anchoring or the remote portion of the blind rivet, the neck breaks and the mandril is pulled from the head. The opening in the blind rivet is sealed because the head remains in the remote portion of the rivet.

The riveting guns which have been employed heretofore in achieving the riveting of blind rivets have included means so that when there was the cycle of operation, a chuck would grip the mandril and pull the mandril until the setting of the rivet and the breaking of the neck of the pulling pin. When the riveter chuck was being returned to its rest position the chuck would release, and the mandril would be ejected from the riveting device. A significant portion of blind rivets have been used in factories where compressed air was available. The compressed air type of riveting device has been much used.

In the construction of buildings however, compressed air tools are less convenient than electric tools. Holes are often drilled by hand-held electric drills. Electrically operated riveting devices have been employed in field installation of blind rivets. Young U.S. Pat. No. 3,774,437 exemplifies a riveting device scheduled to be actuated by an electric drill. The drive shaft of the Young device includes a stub which can be inserted into the chuck of an electric drill. Radial pressure is applied to latch the clutch into engagement in the Young device. The usefulness of a riveting device is dependent to a significant extent on the number of completed operations of rivet installations which the mechanic can complete in an hour. The cost of a riveting tool is less than the week a salary of a worker. The speed of operation has generally been more significant than the cost of the riveting tool. Notwithstanding the thousands of persons using electric drills to drill holes into which they inserted blind rivets, there has not been any satisfactory solution for the long standing demand for a riveting device permitting fast installation of blind rivets in the field, that is, outside of factories equipped with tools for routine production.

SUMMARY OF THE INVENTION

In accordance with the present invention, a riveting device is provided with a clutch which can be engaged by a latching mechanism which is shifted to the latched position by a simple pushing forward on the drive shaft. Some such type of forward pushing on a portion of the riveting device is a necessary feature of the operation of substantially any riveting device because the nose of the riveting tool must be pushed against the flange of the blind rivet after placement in its hole. Thus the present invention avoids loss of time inherent in the prior art types of separate operation for latching the clutch mechanism of the riveting device.

In accordance with the present invention conveniently connectable and disconnectable power transmission means are provided for driving a supplemental tool such as a screw driver, riveter, etc. with an electric drill. The drive shaft of the supplemental tool is provided with a well adapted to receive both the bit and a collar attached near the chuck end of the bit, the collar having one spiral surface adapted to engage with and transmit power to one pin extending into the well of the drive shaft. The pin is adapted to engage for power transmission purposes with such spiral surface of the collar. By the use of the advantageous collar and cooperating socket in the well of the supplemental tool the holes can be drilled with the bit in the electric drill and then between the hole drilling steps, the supplemental tool can be used by inserting the bit and collar into the well of the drive shaft of the supplemental tool. An advantageous method of operation is possible by the use of such power transmission system.

DESCRIPTION OF ILLUSTRATIVE EMBODIMENT

Figure 1:
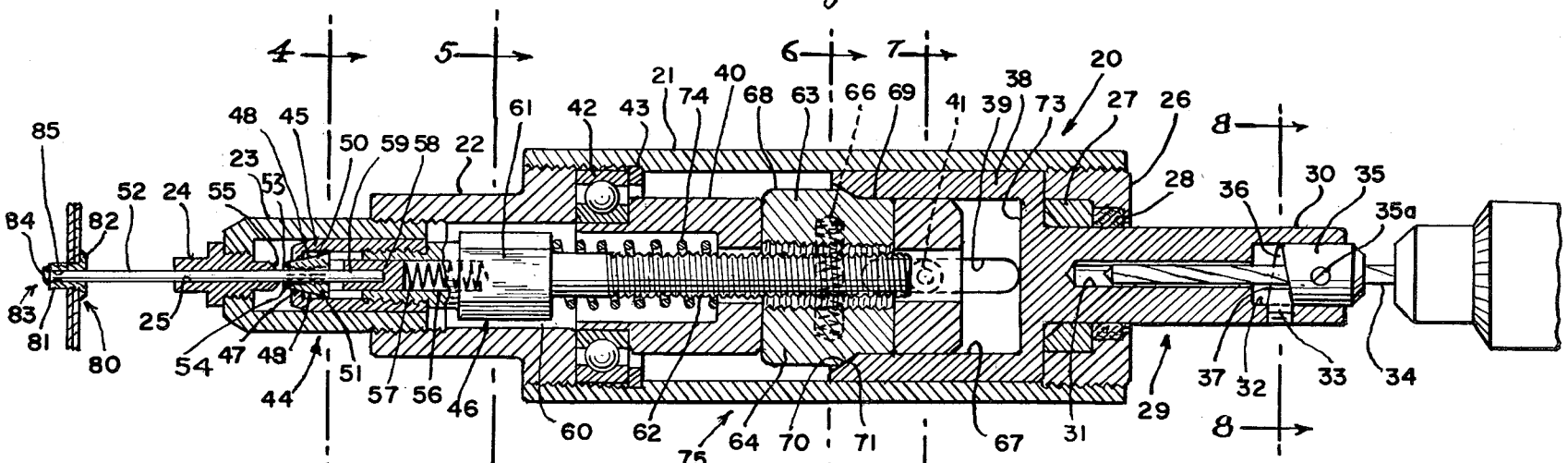
FIG. 1 is a longitudinal cross sectional view of a riveting tool constructed in accordance with the invention.

FIGS. 1 through 9 show one illustrative embodiment of a riveting tool 20 having a casing 21 forward sleeve 23 and an intermediate support 22. Any of several nose pieces 24 may be in threaded engagement with the forward sleeve 23. The opening 25 in nose piece 24 can be selected to accomodate a suitable range of sizes of mandrils. A rear plug 26 is in threaded engagement with the casing 1. A bearing 27 and grease seal 28 in rear plug 26 are in slidable and rotatable engagement with a drive shaft 30. The outer appearance of the riveting tool is controlled by such drive shaft 30, rear plug 26 casing 21, intermediate support 22, forward sleeve 23 and nose piece 24.

Figure 2:
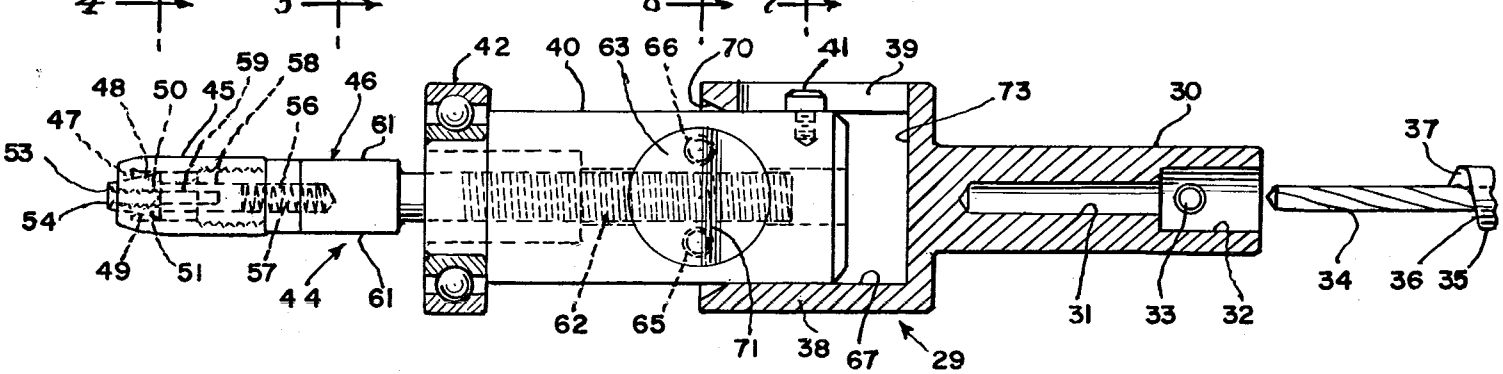
FIG. 2 is in part a plan view and in part a cross sectional view of some internal portions of FIG. 1, but with the apparatus turned 90° from that shown in FIG. 1.

A rotatable assembly 29 comprises drive shaft 30 and the internal portions of the device which rotate with drive shaft 30. As shown in FIG. 2 the drive shaft has a well 31 adapted to accomodate a bit and a well 32 adapted to accomodate a collar 35 secured to bit 34 by sunken set screw 35*a*. A pin 33 serves as a power transmission socket in well 32. Pin engageable surfaces 37 on collar 35 serve to make the collar 35 a power transmission means. Such pin engageable surfaces 37 are approached through the balance of the circumference by spiral surfaces 36, thus making the socket self-guiding. The collar 35 can be attached to bit 34 by sunken setscrew 35*a* before or after the bit is in the electric drill chuck. The combination is adapted for insertion into the wells 31, 32, in the drive shaft, so that the bit need not be removed from its chuck to drive the supplemental tool.

Inside the casing and comprising a part of the rotatable assembly 29 is collar 38 having a slot 39. A pin 41 is threaded into carrier 40 and fits into slot 39 for transmission of power from drive shaft 30 and collar 38 to carrier 40. A bearing 42 secured to carrier 40 serves as both a rotating bearing and thrust bearing. There are left hand threads for connecting the intermediate support 22 and casing 21, whereby the intermediate support is not loosened by rotary forces exerted against it. Bearing 42 is secured against a rear wall of intermediate support 22 by appropriate means such as an expansion ring 43.

In any riveting device for securing blind rivets, it is desirable to avoid excessive weight and inertia in the components which are subjected to the reciprocating cycle of rearward axial movement and return to the forward rest position. An axially shifting assembly 44 of the illustrative embodiment is particularly advantageous because it constitutes only a small proportion of the total weight of riveting device 20. A chuck nose 45 is threadably engaged with an internal member 46. Cam surfaces 47 inside the chuck nose 45 engage with cam surfaces 48, 49 on jaws 51, 51 so that when chuck nose 45 is shifted rearwardly, the jaws grip mandril 52. When the chuck nose 45 is returned to its rest position, cam surfaces 53, 54 on the pair of jaws 50, 51 engage with cam surfaces 55 at the inside of nose piece 24, thereby releasing the jaws from their gripping of mandril 52. A bore 55 in internal member 46 accomodates a spring 57 forwardly urging an ejection cap 58 having a bore 59 adapted to receive the rear portion of mandril 52. When the pin or mandril is inserted in the chuck, it tends to push cap 58 rearwardly against the urging of spring 57. When the internal member 46 is returned forwardly to its rest position the inertia of the cap 58 and the action of spring 57 help to promote the ejection of the mandril during such final stages of the cycle of operation of the riveting device.

Figures 3, 4, 5, 6, 7, 8:
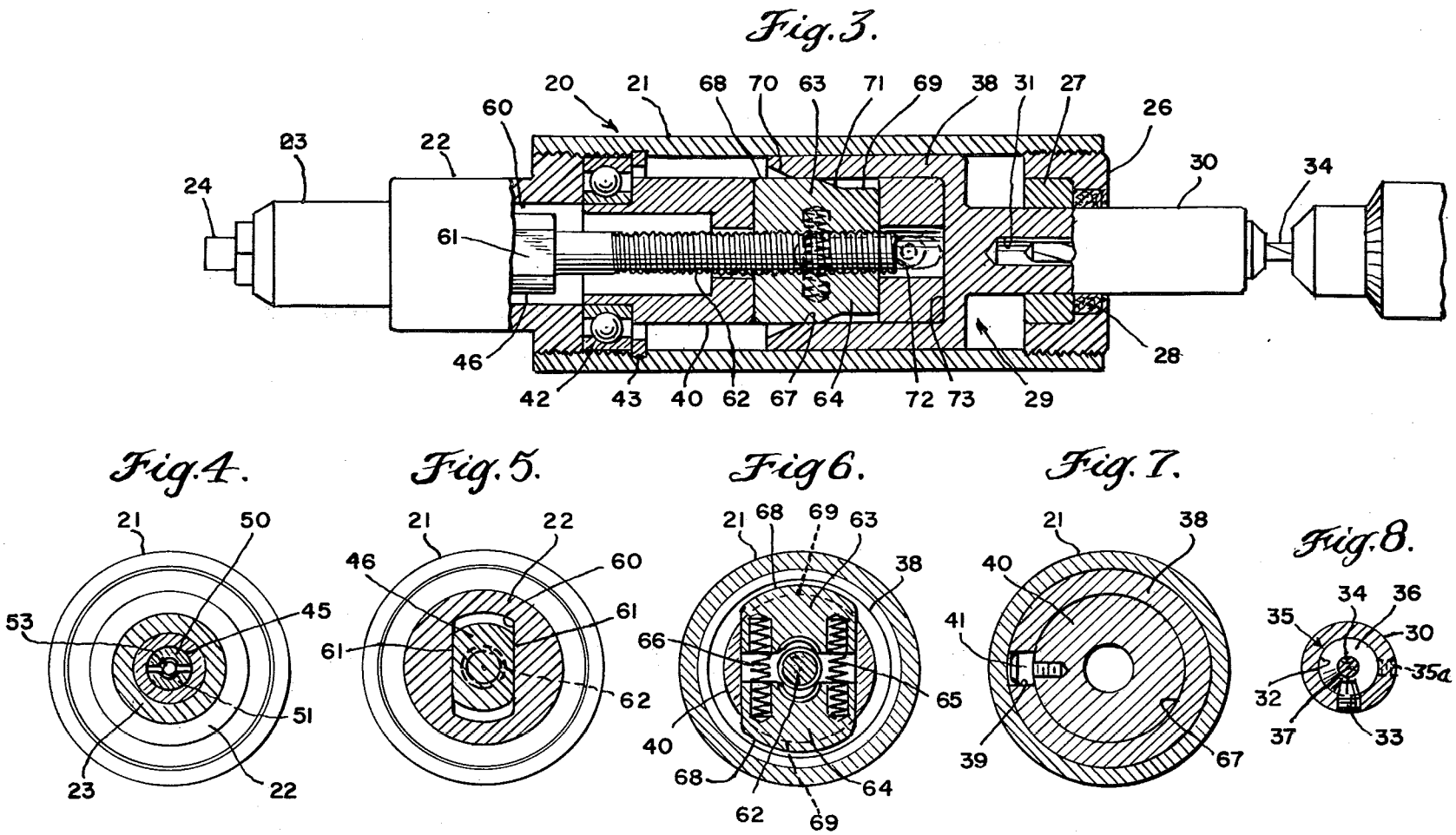
FIG. 3 is a longitudinal cross sectional view with certain parts shown in elevation and is somewhat similar to FIG. 1 except that the drive shaft is shifted axially forward to latch the clutch and to close the split nut into engagement with the axially shiftable screw of the tool.
FIG. 4 is a cross section taken on line 4—4 of FIG. 1 showing the manner in which the chuck of the riveting tool can grip the mandril of a blind rivet.
FIG. 5 is a cross section taken on line 5—5 of FIG. 1 showing an intermediate support adapted to permit an axially shiftable assembly to slide axially for the reciprocating action of a cycle of riveting and securing such assembly so that it does not rotate.
FIG. 6 is a cross sectional view of a split nut having a pair of springs urging the two halves of the split nut into an open position, the nut being adapted for compression into engagement with a screw when the clutch is latched into engagement.
FIG. 7 is a cross sectional view taken on line 7—7 of FIG. 1 showing an axially slidable collar, there being a pin and slot connection between the driving collar and the carrier member for the split nut.
FIG. 8 is a cross sectional view taken on line 8—8 of FIG. 1 showing the manner in which the power transmission collar secured to the bit of an electric drill engages a pin in the socket portion of the well in the drive shaft of the tool.

As shown in FIG. 5 intermediate support 22 has an opening 60 which opening is not round. Thus opening 60 restrains internal member 46 from rotating. Internal member 46 is thus permitted to have only forward and rearward axial movement. Internal member 46 may have a pair of flat surfaces 61 in engagement with opening 60. The intermediate support 22 supports internal member so that no support is necessary at either the chuck nose 45 or at threaded rod 62. As shown in FIGS. 1 and 6, a pair of split nuts 63, 64 are urged apart by springs 65, 66. The split nuts 63, 64 are held in and rotated by carrier 40. The split nut has a surface 69 engageable with the forward end of collar 38 so that the threaded portion of the split nut is spaced only a slight distance from the threaded rod portion 62 of internal member when in the rest position shown in FIGS. 1 and 3. Each split nut 63, 64 has cylindrical surface 68 corresponding generally to the cylindrical surface of carrying member 40. A principal portion of the internal surface of collar 38 has a slip fit with such diameter of carrier 40. The forward edge of collar 38 is cam surface 70 adapted to engage cam surface 71 between small diameter surface 69 and large diameter surfaces 68 on split nuts 63, 64. Particular attention is directed to the difference between FIGS. 1 and FIGS. 3. Collar 38 engages small diameter surface 69 of split nuts 63, 64 in FIG. 1 but is shifted axially forward to engage the large diameter 68 of nuts 63, 64 in FIG. 3. Such axial shifting of the collar from its rearward rest position to its latched forward position is accomplished by a simple pushing movement on the drive shaft 30. The operation of inserting a blind rivet in a hole necessitates setting the nose piece 24 against the exposed flange of the blind rivet so that the latching of the clutch involving such simple push forward of the drive shaft 30 is a step which the operator readily learns without any significant loss of time in the riveting operation.

As soon as the electric drill (after the collar 35 has engaged pin 33) rotates the drive shaft 30 while collar 38 maintains the engagement of split nuts 63, 64 with threaded rod 62, the axially shiftable assembly 44 begins its rearward axial movement.

As shown in FIG. 7 a pin 47 which is threaded into carrier 40, fits into slot 39 of power transmission collar 38. A bore at the axis of carrier 40 is shown as an opening through which (see FIG. 9) it is possible for threaded rod 62 to axially shift.

As shown in FIG. 8, bit 34 carries collar 35 having pin engageable surfaces 37 which are automatically self-guided into engagement with pin 33 by spiral surfaces 36. Drive shaft 30 has a well 32. If pin 33 becomes worn, it is readily replaced by unthreading the recessed screw and threading in a new pin.

The shifting of the collar 38 between its two positions, engaging either clutch engagement surface 68 of split nuts 63, 64 or clutch disengagement smaller diameter surface 69 of split nuts 63, 64 serves to engage or disengage the clutch. When the clutch is engaged as shown in FIG. 3, the rotation of the drive shaft 30, collar 38 and carrier 40 causes the split nuts 63, 64 to rotate as part of the rotating assembly 29. Such rotation of split nuts 63, 64 transmits power to threaded rod 62 (a screw) which is thereby axially shifted rearwardly, thereby pulling the mandril and setting the blind rivet. The shape of threads in split nut 63, 64 and threaded rod 62 are adapted for power driven screws and not for fasteners.

Figure 9:
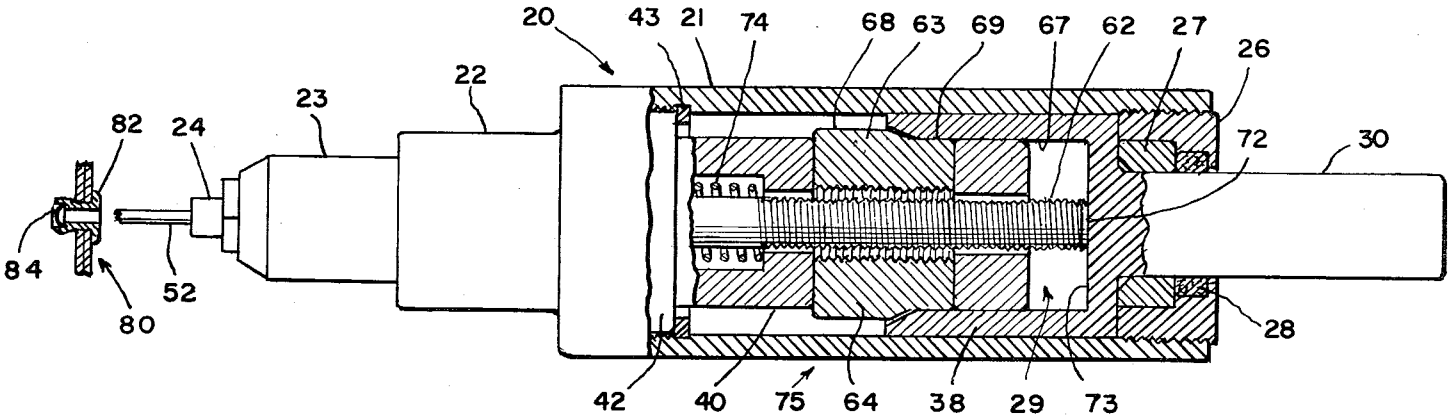
FIG. 9 is a cross sectional view resembling FIG. 1 except that the threaded rod is not at its rest position but near the end of its rearward shifting as the clutch is about to be disengaged by such powered shifting of the threaded rod.

As shown in FIG. 9, the end of threaded rod 72 is rearwardly advanced until it engages a rear wall 73 of collar 38. Thereafter the rearwardly moving rod 72 pushes the collar 38 until its inner walls 67 are shifted from large diameter 68 to small diameter 69, thereby disengaging the clutch and terminating the power driven rearward movement of collar 38.

While the rotating split nuts 63, 64 are axially shifting the threaded rod 62 rearwardly, a spring 74 is being compressed. Hence as soon as threaded nuts 63, 64 are spread apart by the disengagement of clutch means 75 the axially shiftable assembly 44 is returned to its rest position by the action of spring 74.

In the operation of the riveting device, the drive shaft 30 is pushed to latch the clutch means 75 with collar 38 over large diameter 68 of split nut 63, 64. The collar 35 is inserted into well 32 so that the cam 37 on collar 35 engages pin 33 in well 32. The bit extends into well 31. When the electric drill is started, the drive shaft 30 is driven thereby rotating the split nut 63, 64. Threaded rod 62 is axially shifted rearwardly, thereby pulling mandril 52 gripped by the pair of jaws 50, 51 in the chuck nose 45.

Blind rivet 80, as it is initially employed, comprises tubular shank 81 and radially enlarged flange 82 so that the rivet does not go through the relatively snug hole into which the shank 81 is positioned. The blind rivet comprises setting means 83 including a head 84 having cam surfaces adapted to enlarge the diameter of the remote portion of the tubular shank 81 as the head 84 is drawn rearwardly by the tool 20. A neck 85 connects the head 84 with mandril 52 for the pulling of the head 84 from its rest position to the anchored position. The neck 85 has sufficient tensile strength to permit the anchoring of the remote portion of the rivet but the neck 85 does break when the head 84 is shifted into its final position, thereby releasing the mandril 52 from the blind rivet. The jaws 50, 51 continue to grip the mandril 52 during its rearward movement, but when the spring 74 returns the axially shiftable assembly 44 to its rest position, cam 55 on nose piece 24 engages with cams 53, 54 on jaws 50, 51 to automatically open and release the jaws from the mandril 52 so that mandril 52 can be ejected by the inertia action of ejection cap 58. It should be noted that the rearwardly shifting threaded rod 62 eventually engages rear wall 73 of the bore of collar 38 thereby power driving collar 38 from engagement position, whereby walls 67 of the internal surface of collar 38 engage with small diameter surface 69 of split nuts 63, 64 instead of the large diameter surfaces 68 of said split nuts 63, 64. Thus there is power disengagement of clutch means 75. The clutch means 75 is latched for a controlled cycle of operation comprising such power disengagement of the clutch means.

Figure 10:
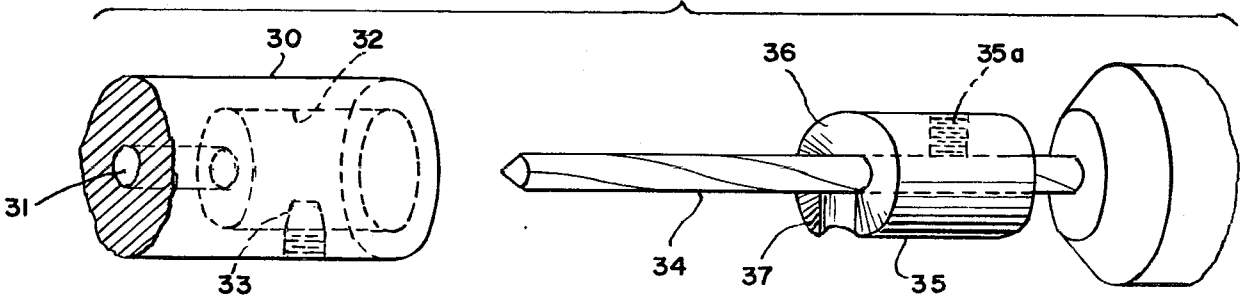
FIG. 10 is a perspective view of a power transmission system, utilizing a collar attached to a bit in a drill having a motor rotating the bit.

Any tool such as a riveter, screw driver, or other device used intermittently with an electric drill having a bit for drilling holes can benefit from the advantageous power transmission means of the invention. As shown in FIG. 10, a collar 35 is secured to a bit 34 with a recessed set screw **35*a*. The collar 35 has a spiral surface terminating in a cam 37 engageable with pin 33 in the socket or well 32. The combination of such well 32 and pin 33 can be treated as a socket for power transmission from power transmission collar 35**. Particular advantages are obtained because there is only a single pin and a corresponding cam on the collar. The self guiding socket functioning are not as effective at such small diameter if, for example, four pins and four spirals are used.

Under normal circumstances the drive shaft is latched into engagement prior to the insertion of the power transmission means. The latching of the clutch can occur after the collar 35 is inserted in well 32. The small inertia of the axially shiftable assembly is advantageous during any engagement of the clutch means 75 while the drive shaft 30 is rotating.

The various illustrative embodiments are merely examples of concepts more accurately defined in the appended claims.

The invention claimed is:

1. A power transmission mechanism comprising a collar attachable to a bit, said bit being scheduled for intermittent selective use as a rotating bit, a driven number adapted to actuate a supplimental tool, said member having a well on one end thereof, said well including a single transverse pin therein said power transmission collar being scheduled for intermittent selective use for transmitting power from said rotating bit to said driven member without impairing the usefulness of the bit when dissociated from the supplemental tool, said collar having a self-guiding single spiral surface and a single power-transmission surface engageable with said single pin, said collar fitting into said well of said driven member and against said single cylindrical pin, the axis of which is directed radially inwardly toward the axis of the collar and well, the tip of said single pin being spaced from the bit, said pin having surfaces toward which said single spiral surface guides the collar to said single power-transmission surface engagement with said single pin.

* * * * *